US005372428A

United States Patent [19]

Bruno et al.

[11] Patent Number: 5,372,428

[45] Date of Patent: Dec. 13, 1994

[54] TAMPER EVIDENT BAG WITH PERFORATIONS ON THE SIDES AND ON THE FLANGES

[76] Inventors: Edward C. Bruno, 15336 Penwood Pl., Aurora, Colo. 80015; Roger A. Davison, 8761 Galen Ct., Denver, Colo. 80229

[21] Appl. No.: 222,232

[22] Filed: Apr. 4, 1994

[51] Int. Cl.[5] ..... B65D 33/34

[52] U.S. Cl. ..... 383/5; 383/63

[58] Field of Search ..... 383/5, 61, 63

[56] References Cited

U.S. PATENT DOCUMENTS 4,744,674 5/1988 Nocek ..... 383/5 X 4,846,585 7/1989 Boeckmann et al. ..... 383/5

4,923,309 5/1990 Van Erden ..... 383/5

4,964,739 10/1990 Branson et al. ..... 383/5

5,118,202 6/1992 Bruno ..... 383/63 X

*Primary Examiner*—Allan N. Shoap

*Assistant Examiner*—Jes F. Pascua

*Attorney, Agent, or Firm*—Leo J. Aubel

[57] ABSTRACT

A positive locking mating profile system for plastic bags which bags are made to have an initially open mouth, and wherein once the profiles are engaged and closed, the mouth of the bags can not be opened without giving evidence of tampering and/or without damaging the bags.

1 Claim, 3 Drawing Sheets

TAMPER EVIDENT BAG WITH PERFORATIONS ON THE SIDES AND ON THE FLANGES

BACKGROUND OF INVENTION

This invention is related generally to U.S. Pat. No. 5,118,202 issued on Aug. 29, 1990 to Edward C. Bruno, one of the co-inventors of the present invention in that said patent is directed to a tamper proof recloseable plastic bag.

Recloseable bags made with male and female mating profiles are known in the art. In one type of commonly used recloseable bags, an arrowhead shaped male mating profile is received in a female member which engages and retains the male member in locked engagement. In order to permit the disengagement or unlocking of the profiles, one side of the arrowhead is rounded and/or made shorter or smaller to facilitate disengagement from the female member when the profiles are forcibly pulled apart. The foregoing permits the bag to be closed, opened and reclosed as necessary.

Another common type of mating profiles is disclosed in U.S. Pat. No. 2,823,720 wherein the mating profiles comprise a three legged configuration in which the three legs of one profile straddle the three legs of the other profile and certain of the legs have arrowhead shaped ends which are engaged by hooked shaped ends of other legs. Other configurations of mating profiles are disclosed in U.S. Pat. Nos. 4,731,911; 4,736,451; 4,964,739; and 5,017,021.

In addition to U.S. Pat. No. 5,118,202, cited above, various prior art patents including U.S. Pat. Nos. 4,832,505 and 3,618,281 disclose recloseable plastic bags which provide tamper evidencing means. The purpose or feature of such bags is to assure that product, once placed within the bag, has not been tampered with, damaged, or despoiled before it reaches the intended user.

SUMMARY OF INVENTION

The invention discloses mating profiles and plastic bags having mating profiles which can be closed to lock and wherein said profiles can not be separated and/or the bag opened without giving evidence of tampering.

Further features and advantages of the present invention will become apparent from the following description, claims and drawings.

DESCRIPTION OF THE INVENTION

Figure 1B:
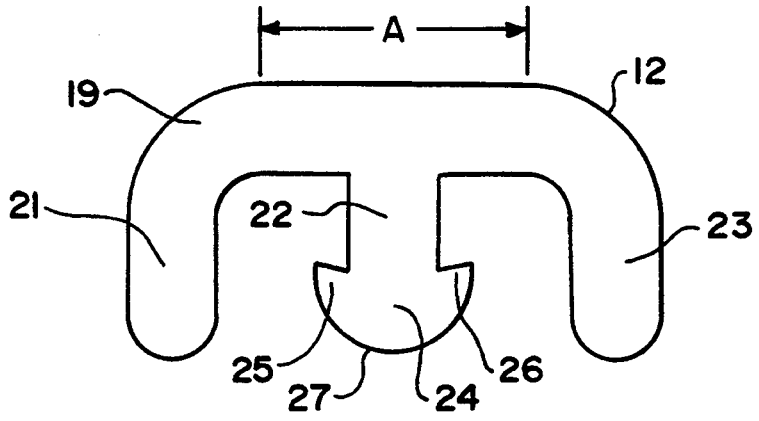
Figs. 1B and 1C respectively show separate end views of the male profile and of the female profile of FIG. 1A.
Figure 1A:
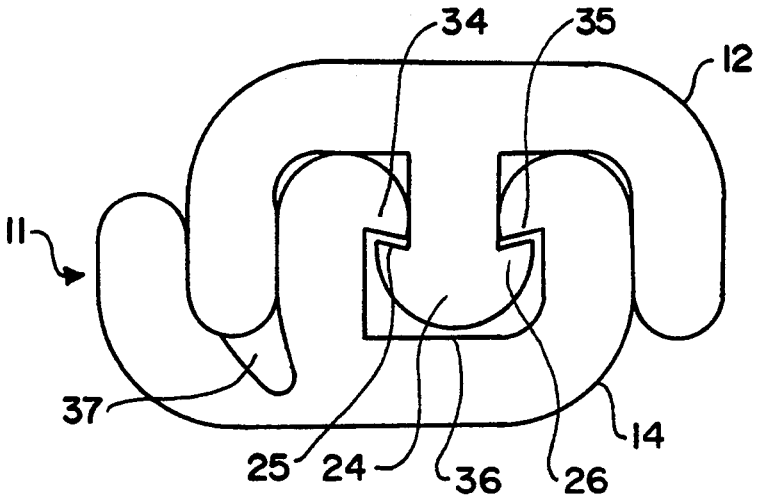
FIG. 1A shows a cross section of a first embodiment of the mating profile system for the inventive bag showing the male and female profiles of the system in engaged or locked position.
Figure 1C:
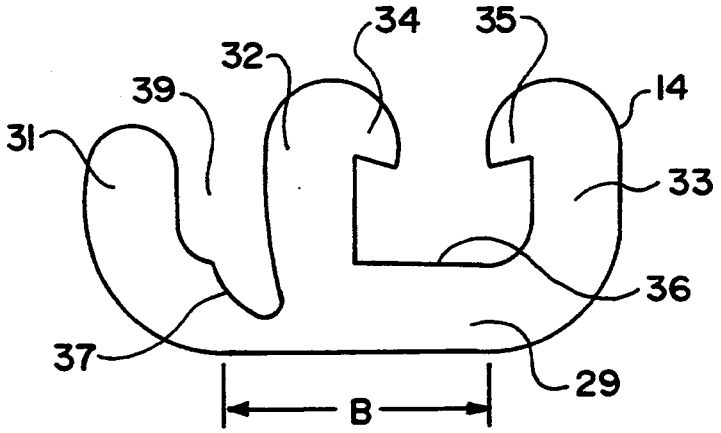

FIG. 1A shows an enlarged view, partly in cross section, of the inventive mating profile system pair 11 comprising a first or male profile 12 and a second or female profile 14 in an engaged or locked condition. FIGS. 1B and 1C respectively show profiles 12 and 14 in a non-engaged condition and are included herein to permit clarity in numbering. As is known, the profile pair 11 is extruded as a continuous length of plastic material.

As shown in FIGS. 1A, 1B and 1C, in a preferred embodiment of the invention, profiles 12 and 14 are each formed in roughly the shape of an "m" with a base and three extending legs. The profile 12 has a base 19 and legs 21, 22 and 23; and, the profile 14 has a base 29 and legs 31, 32 and 33.

The center leg 22 of profile 12 terminates in the shape of a symmetrical arrowhead 24 which has flared hook ends 25 and 26 and a rounded or curved tip or crown 27. Two legs 32 and 33 of profile 14 terminate at their free ends in inwardly extending hooks 34 and 35 in some what of a "C" shaped configuration. Leg 22 of profile 12 including arrowhead 24 is received in a recess 36 formed between legs 32 and 33 of profile 14. The hooks 34 and 35 of legs 32 and 33 of profile 14, respectively, are provided to engage the flared ends 25 and 26 of arrowhead 24 of profile 12.

A slit 37 is cut or formed to extend from the recess 39 between legs 31 and 32 into the base 29 of profile 14. The slit 37 can comprise a simple slice or narrow cut in the plastic material; in the various drawings, the size of the slit 37 is enlarged for purposes of clarity. The slit 37 is preferably cut downwardly from adjacent the outer edge of leg 32 and angled inwardly to extend toward the center of leg 32. The slit 37 tends to open when the leg 21 of profile 12 is inserted into recess 39. The function of slit 37 will be described hereinbelow with reference to FIG. 6.

As shown in FIG. 1B, the legs of the two mating profiles 12 and 14 straddle or nest in each other when they are operably engaged to close or lock. The crown 27 of arrowhead 24 is spaced from the bottom of the recess 36 formed between legs 32 and 33 of profile 14 when the profiles 12 and 14 are closed.

Figure 2:
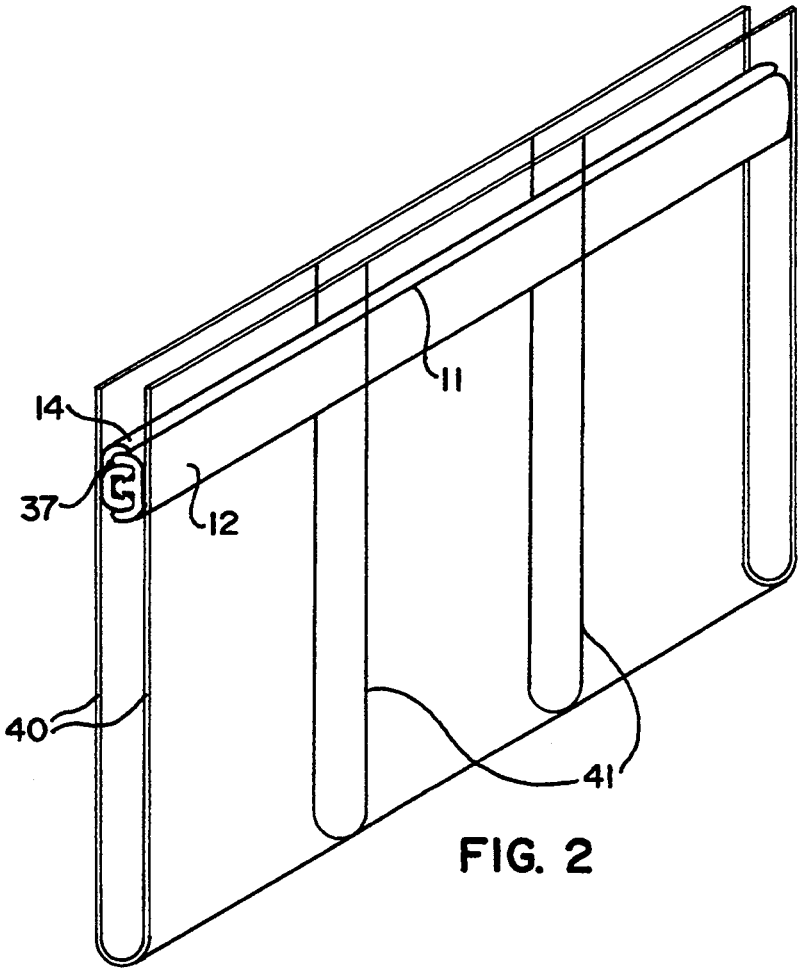
FIG. 2 shows a length of plastic tubing or film material from which the inventive bags are made; as is well known in the art, the male and female profiles may be extruded concurrently with the tubing.

FIG. 2 shows the film material 40 with the mating profiles 12 and 14 extruded therewith, which as stated above is well known in the art. The portion of each of the profiles 12 and 14 which bonds to film 40 and hence to the respective sides 18 and 20 of bag 10 (se FIG. 3) is indicated as length and section A in FIG. 1B, and the length and section B in FIG. 1C. FIG. 2 also shows the well known transverse seal lines 41 which effectively form the bags.

Figure 3:
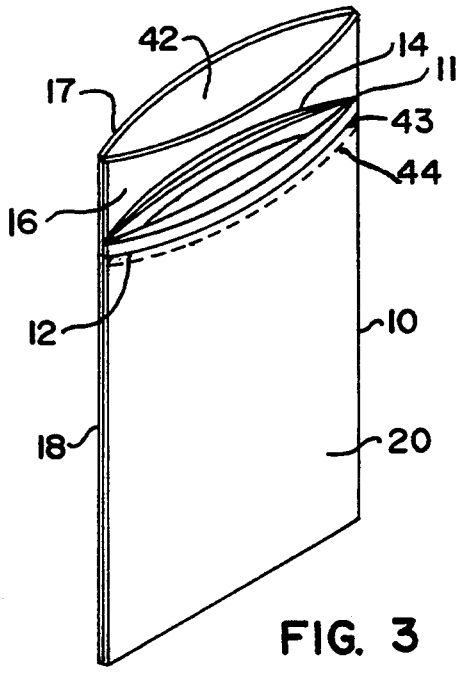
FIG. 3 shows a plastic bag formed in accordance with the invention wherein perforations are formed on the sides of the bag to further assure against tampering; note that for purposes of clarity in the drawing of FIG. 3 (that is, so that the perforation lines 43 and 44 would not overlap and clutter the profile lines 12 and 14,) the perforations line 43 has been foreshortened; however in practice the line 43 extends entirely across the side of the bag similarly to line 44.

FIG. 3 shows a finished bag 10. Bag 10 includes sides 18 and 20, and flanges or tabs 16 and 17 extending upwardly from the profiles 12 and 14, respectively. As mentioned above, the plastic bags 10 made in accordance with the invention, are made with an opening, that is mouth 42 of the bag 10 is open when the bag 10 is completed; that is, the mating or locking profiles 12 and 14 are not engaged when the bag 10 is completed. U.S. Pat. No. 5,094,707 issued to Edward C. Bruno a co-inventor herein discloses a method of making open bags.

In normal usage, the inventive bag 10 is received by the bagger or operator with and open mouth 42 as shown in FIG. 3. The bag is positioned or picked up by the bagger or operator, and product is inserted in the mouth 42 of bag 10. Next, the locking profiles 12 and 14 are pressed together and locked. Thus the bag 10 does not need to be opened by the bagger or operator when the bag is to be filled with product. The foregoing eliminates at least one time consuming operation or step in the bag filling and closing process and product can be readily and efficiently inserted in the bag 10. Next, the profiles 12 and 14 can be engaged thereby closing and substantially permanently locking the bag 10.

In the present invention and as seen from FIG. 1B, the areas of contact of the inventive mating profiles 12 and 14 which comprises a curved surface or crown 27 of arrowhead 24 is spaced from the flat surface of recess 36 of profile 14, and the flanges 25 and 26 of arrowhead 24 profile 12 are spaced from hooks 34 and 35 of profile 14.

As mentioned above, a slit 37 is cut or formed to extend from the recess 39 between legs 31 and 32 into the base 29. Slit 37 extends downwardly from the juncture or edge of leg 32 proximate to the flange 17 into the base 29 of profile 14. The slit 37 is preferably cut downwardly from adjacent the outer edge of leg 32 and angled inwardly toward the center of profile 14.

The inventive profiles provide and inventive bag 10 provide a tamper resistant bag; in other words bag 10 will not open without giving evidence that the bag has been opened, as will now be described with reference to FIG. 6.

Figure 6:
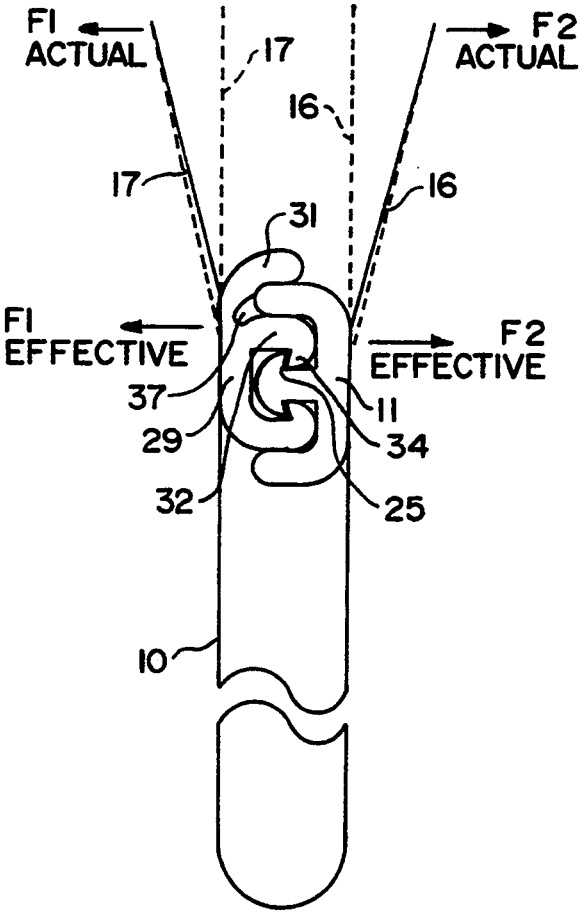
FIG. 6 is sketch useful in explaining the operating concept of the inventive profile system.

Referring to FIG. 6, the actual force F1 applied to pull on the flange 17 to open bag 10 is transmitted to leg 31 of profile 12, and the effective force F1 on leg 31 effects or provides a hinging action which opens the slit 37, which is a weak section or area of profile 14. Note also that the lever or moment arm of the actual Force F1 is shortened to an effective Force F1. The effective force F1 is transmitted by the hinging action to the section or area of base 29 under slit 37. Due to such hinging action, the effective force F1 provides a substantially perpendicular force to the areas of engagement of hook 34 and flared end 25. The effective force F1 has an action substantially perpendicularly to the engaging hooks 34 and 35 of profile 14 and flared ends 25 and 26 of profile 12.

Note further that when an attempt is made to open the bag 10 by pulling apart the flanges 16 and 17, the spacing between the crown 27 of arrowhead 24 of profile 12 and the surface 36 of profile 14 permits the curved crown 40 surface to move and pivot in a rolling motion against the bottom of recess 36, causing hook 25 of arrowhead 24 to engage hook 34 of profile 14. The actual force F2 applied to flange 16 to open the bag 10, provides and effective Force F2 at the position and in the direction indicated in FIG. 6. Note also that the lever or moment arm of the actual Force F2 is shortened to an effective Force F2. Thus the effective forces F1 and F2 tending to separate the hooks 34 and 35 of profile 14 from the arrowhead flared hook ends 25 and 26 of profile 12 are effective substantially perpendicularly against the engaging portions of the mating profiles 12 and 14. All of the foregoing makes it extremely difficult to separate the profiles. Consequently, the flanges 16 and 17 will be torn, and the bag 10 damaged by attempts to open the bag, but the locked profile system 11 will not disengage, thereby providing positive evidence of tampering when attempts are made to open bag 10. Thus, when once engaged, the mating profiles 12 and 14 are positively, and essentially permanently, locked; that is, the profiles can not be opened or unlocked in normal use and operation without damaging the bag 10.

It has been found that attempts are also made to open bags such as bag 10 by grasping the sides or walls 18 and 20 of the bag 10 and pulling the sides apart. Importantly, bag 10 includes perforations 43 and 44 on the sides 18 and 20, below and parallel to profiles 12 and 14. Normally, profiles 12 and 14 lock sufficiently firmly so that the flanges or film of the bag 10 is torn before the profiles 12 and 14 can be separated. However, it has been found that in some instances profiles 12 and 14 may disengage when attempts are made to open the bag 10 by pulling the sides 18 and 20 of the bag apart. Therefore, as a further deterrent to tampering, and particularly for bags made of relatively heavier and hence stronger plastic film, the perforations 43 and 44 provide weakened film lines which will cause the sides of 43 and 44 of bag 10 to tear when efforts are made to open the bag by pulling the sides of the bag apart. This will give and immediate and readily visible indication of tampering with bag 10.

Figure 4:
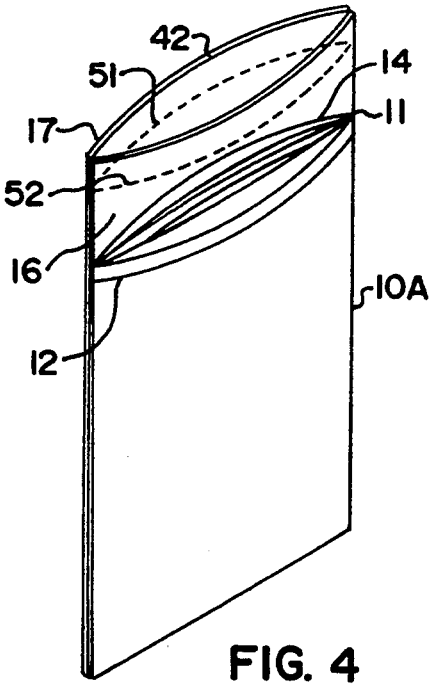
FIG. 4 shows a second embodiment of invention wherein perforation are formed on the flange of the bag and on the bag to further assure against tampering; note that for purposes of clarity in the drawing of FIG. 4 (that is so that the perforation lines 51 and 52 would not overlap and clutter the profile lines 12 and 14), the flanges 16 and 17 have been elongated and the perforations 52 have been shown further removed from the profiles 12 and 14 than used in practice.

FIG. 4 shows another embodiment of the invention wherein the bag 10A is identical to bag 10 of FIG. 3, and which includes a further means for providing a tamperproof bag. Bag 10A includes perforations 51 and 52 above, and parallel to, the profiles 12 and 14 on flanges 16 and 17. In addition to the positive locking action provided by the hinge effect of slit 37, perforations 51 and 52 provided a weakened line on flanges 17 and 16 which tend to cause the flanges to tear when the actual forces F1 and F2 are applied to the flanges such as when attempts are made to open bag 10A. Torn flanges will give evidence of tampering. Note also, that if the flanges or tabs 16 and 17 are once torn only a short piece of flange film material will remain, and this short piece of film is difficult to grasp for further attempts at opening of bags 10 and 10A.

Figure 7:
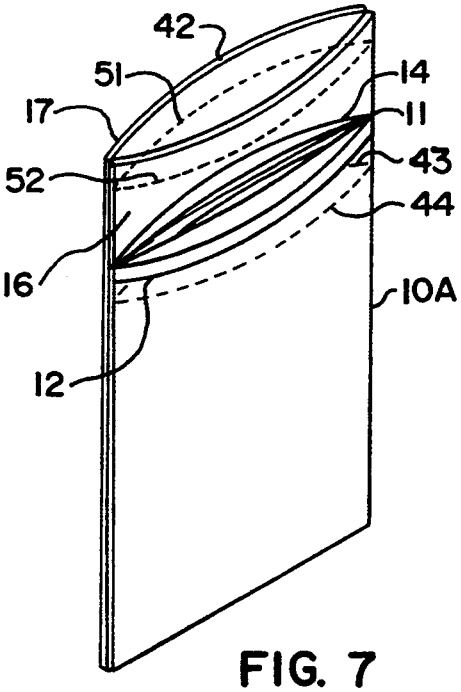
FIG. 7 shows another embodiment of the inventive bag.

FIG. 7 shows that perforation lines 43 and 44 on the sides 18 and 20 of a bag, as well as perforations 51 and 52 on flanges 17 and 16 can be formed on the same bag, as another important embodiment of the invention.

Figure 5:
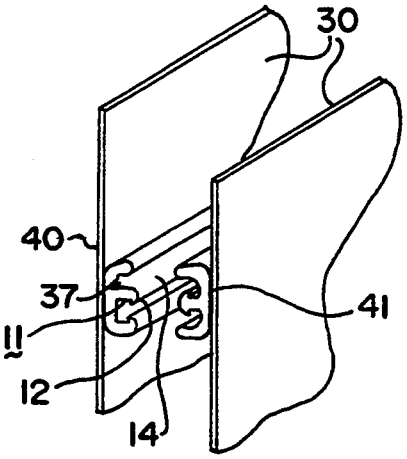
FIG. 5 shows the mating profiles formed on a strip of plastic which is then fused to the sides of the plastic tubing for subsequently forming bags.

FIG. 5 shows a variation of the inventive profile system 11 wherein, profiles 12 and 14 are formed on respective elongated strips of plastic film 40 and 41. The strips are 40 and 41 are then fused to the plastic film forming the bags 10 or 10A. Otherwise, bags made with the strips 40 and 41 are similar to the bags made with extruded profiles of FIG. 2. The profiles 12 and 14 of FIG. 5 are the same as the profiles 12 and 14 shown in all the other drawings.

Each of the features of the inventive profile and tamper proof bag; that is, the positive locking profiles, the shortened effective lever arm, the hinging action of the slit, the perforations on the sides of the bag, and the perforations on the flanges of the bag are each individually effective to provide a tamper proof bag. However, the combination of two or more of the above features provides an even better tamper proof bag.

While the invention has been particularly shown and described with reference to a preferred embodiment thereof, it will be understood by those skilled in the art, that various changes inform and detail can be made therein without departing from the spirit and scope of the invention.

We claim:

1. A plastic bag having sides and an initially open mouth, facing flanges extending from said sides, plastic mating profile means affixed to said bag sides, said profile means being engageable to substantially lock and provide a means of locking the mouth of the bag, said profile means comprising first and second mating profiles, a line of perforations formed in at least one of said flanges alongside said profiles to provide a weakened line on said at least one of said flanges, a line of perforations in at least one of said sides of the bag alongside said profiles to provide a weakened line on said at least one of said sides, said perforations enabling tearing of said flanges and sides when attempts are made to open said bag to thereby give evidence of tampering.

* * * * *

UNITED STATES PATENT AND TRADEMARK OFFICE

CERTIFICATE OF CORRECTION

PATENT NO. : 5,372,428

DATED : Dec. 13,1994

INVENTOR(S) : Edward C. Bruno and Roger A. Davison

It is certified that error appears in the above-identified patent and that said Letters Patent is hereby corrected as shown below:

We claim:

1. A plastic bag having sides and an initially open mouth, facing flanges extending from said sides, plastic mating profile means affixed to said bag sides, said profile means being engageable to substantially lock and provide a means of locking the mouth of the bag, said profile means comprising first and second mating profiles, a line of perforations formed in at least one of said flanges alongside said profiles to provide a weakened line on said at least one of said flanges enabling tearing of said flanges and sides when attempts are made to

UNITED STATES PATENT AND TRADEMARK OFFICE

CERTIFICATE OF CORRECTION

PATENT NO. : 5,372,428

DATED : Dec. 13, 1994

INVENTOR(S) : Edward C. Bruno and Roger A. Davison

It is certified that error appears in the above-identified patent and that said Letters Patent is hereby corrected as shown below:

open said bag to thereby give evidence of tampering.

Signed and Sealed this

Thirteenth Day of June, 2000

*Attest:*

Q. TODD DICKINSON

*Attesting Officer*

*Director of Patents and Trademarks*